United States Patent [19]

Sherwood et al.

[11] 4,202,752

[45] May 13, 1980

[54] CELL WITH MULTIPLE ANODE-CATHODE CHAMBERS FOR FLUID BED ELECTROLYSIS

[75] Inventors: William G. Sherwood, Golden; Donald R. Hodges, Denver, both of Colo.; Cvetko Nikolic, Harvey, La.

[73] Assignee: Amax Inc., Greenwich, Conn.

[21] Appl. No.: 26,493

[22] Filed: Apr. 3, 1979

Related U.S. Application Data

[63] Continuation-in-part of Ser. No. 12,177, Feb. 16, 1979, and Ser. No. 12,178, Feb. 16, 1979.

[51] Int. Cl.[2] ..... C25D 17/00; C25D 21/04; C25D 21/12; C25D 21/16

[52] U.S. Cl. ..... 204/222; 204/237; 204/260; 204/263; 204/266

[58] Field of Search ..... 204/260, 263, 222, 264–266

[56] References Cited

U.S. PATENT DOCUMENTS

| | | | |
|---|---|---|---|
| 673,452 | 5/1901 | Roberts | 204/260 |
| 2,912,372 | 11/1959 | Stoddard | 204/260 X |
| 3,853,735 | 12/1974 | Sheppard, Jr. et al. | 204/260 |
| 3,891,532 | 6/1975 | Jensen et al. | 204/260 |
| 3,954,594 | 5/1976 | Recht | 204/263 |

*Primary Examiner*—John H. Mack
*Assistant Examiner*—D. R. Valentine
*Attorney, Agent, or Firm*—Michael A. Ciomek; Eugene J. Kalil

[57] ABSTRACT

A fluid bed electrolysis cell and system are provided for efficiently extracting electroplatable metal ions from an electrolyte, the cell employed having preferably a plurality of anodes and cathodes concentrically disposed relative to each other, each of the anodes being partitioned from each of the cathodes by a porous diaphragm such as to define a plurality of anode chambers and cathode chambers. Each of the cathode chambers are adapted to support a fluidizable cathode bed of electrically conductive particulate material, e.g., powdered nickel, copper, and the like.

14 Claims, 8 Drawing Figures

CELL WITH MULTIPLE ANODE-CATHODE CHAMBERS FOR FLUID BED ELECTROLYSIS

This application is a continuation-in-part of copending U.S. applications Ser. No. 012,177 and No. 012,178, both filed on Feb. 16, 1979, the disclosures of which are incorporated herewith by reference.

This invention relates to a fluid bed electrolysis cell and system and, in particular, to a fluid bed electrolysis cell comprised of multiple anode-cathode chambers for use in extracting metals from electrolytes, such as dilute electrolyte solutions, leaching solutions, and the like.

RELATED APPLICATIONS

In copending applications Ser. No. 012,177 and No. 012,178 (both filed Feb. 16, 1979), a fluid bed electrolysis system is disclosed comprising a cell having an axially disposed anode surrounded by a cathode, the anode being partitioned from the cathode by a porous diaphragm. The porous diaphragm defines an anode chamber surrounded by an annular cathode chamber, the annular cathode chamber being adapted to support a fluidizable cathode bed of electrically conductive particulate material, the system having electrolyte circulating means for recirculating electrolyte through the cell and for maintaining the electrically conductive particulate material in an electrochemically active fluidized state. The foregoing cell is referred to as a cell containing side-by-side electrodes.

The aforementioned fluid bed cell has been found to be quite attractive from operational, current efficiency and scale-up standpoints. Test results have indicated that the particulate bed should preferably be highly conductive and that the particle size and density should be selected to permit uniform fluidization in the chosen electrolyte. Thus, the bed expansion should be such as to maximize particle-to-particle contact while maintaining sufficient movement to prevent particles from growing together (e.g., agglomerate together).

It has also been observed that the membrane should preferably have uniform porosity, minimum resistance and be capable of withstanding particle abrasion and weight, and, in addition, be smooth to avoid particle hang-up. The electrolyte should be circulated throughout the cell to inhibit the formation of dead areas within the particulate bed and provide for oxygen removal from the anode compartment to minimize electrical resistance within the system. Test results have also shown that increasing the temperature of the electrolyte increases electrolyte conductivity which in turn enhances potential uniformity across the bed and reduces cell voltage, the higher operating temperatures also reducing the overvoltage for activation controlled reactions.

It has now been found that the advantages of the fluid bed electrolysis cell can be further enhanced by employing a cell having multiple anode-cathode chambers.

BACKGROUND OF THE INVENTION

Side-by-side electrodes have been proposed using a fluid bed electrode into which a second electrode is inserted, the second electrode being coated with an insulating material, e.g., polypropylene, of sufficient porosity to provide current flow while avoiding shorting of the cell. Various embodiments of side-by-side electrodes are disclosed in the literature.

In an article entitled "A Preliminary Investigation of Fluidized Bed Electrodes" by J. R. Backhurst el at (Journal of the Electrochemical Society [Electrochemical Technology]; Nov., 1969, pp. 1600–1607), a cell with a side-by-side electrode is disclosed for use in the cathodic reduction of the organic compound nitro benzene sulfonic acid to metanilic acid in aqueous sulfuric acid, a typical cell comprising a cathode bed of copper powder in a cathode chamber isolated by a porous diaphragm which in turn is surrounded by an annular anode (e.g., a lead anode) to provide a cell having a concentric configuration. In cathodically reducing the organic compound, copper-coated glass particles of 450 to 520 micron size were employed, the fluidized bed volume ranging from about 5% to 25% greater than the static bed volume.

In a paper entitled "Feasibility Study On The Electrowinning of Copper With Fluidized-Bed Electrodes" by J. A. E. Wilkinson et al (Institute of Mining and Metalurgy [London]; Sept. 1972, Vol. 81, pp. C157–C162), a fluidized-bed electrode is disclosed for the electrowinning of copper from leach liquors and other solutions. A side-by-side configuration proposed comprised anode and cathode compartments separated by a non-porous ion exchange membrane, the cathode comprising the fluidized bed. The results indicated that copper could be deposited from dilute solutions.

Another paper of interest is one entitled "The Fluidized Bed in Extractive Metallurgy" by D. S. Flett (Chemistry and Industry; Dec. 16, 1972, #24, pp. 983–988). In this paper, a side-by-side electrode configuration is disclosed comprising a vertical cell in which a fluidized bed is supported vertically on one side of the cell by a membrane and in which a vertically disposed anode is spaced to one side of the membrane-supported fluid bed. The electrolyte is fed from a leach circuit to the fluidized cathode cell for the recovery of metal values therefrom.

A number of cell configurations are considered in the paper entitled "Feasibility Study On The Electrowinning of Copper With Fluidized-Bed Electrodes" by J. A. E. Wilkinson et al (Institute of Mining and Metallurgy [London]; Vol. 82, pp. C199–C125, 1973). One arrangement comprises a side-by-side electrode configuration formed of concentric anode and cathode compartments. In this configuration, the cathode feeder which is tubular is embedded in the bed such that part of the bed is shielded from the anode which is not desirable.

In U.S. Pat. Nos. 3,941,669 and 3,951,773 assigned to Noranda Mines Limited, a fluidized bed electrode system is disclosed comprising an electrode chamber having a porous bed, a main electrode consisting of a bed of electrically conductive particles, an auxiliary electrode (i.e., an anode) with the surface thereof partially impregnated with a synthetic organic fiber screen cloth so that the auxiliary electrode can be introduced into the fluidized bed without risk of forming a short circuit, a current feeder extending into the bed, means for feeding a fluidizing gas into the bed of particles, and means for feeding solution through the fluidized bed.

U.S. Pat. No. 3,988,221 discloses the use of a cathodic fluid bed for the electrolytic removing of heavy metal ions from solution. The cell employed uses a centrally disposed anode with a permeable coating thereon so that the anode can penetrate the fluid bed without shorting the cell.

It would be desirable to provide a relatively high capacity fluid bed electrode system utilizing a cell having a plurality of anode-cathode chambers for use in extracting nickel from laterite leach solutions which normally contain less than about 10 grams per liter (gpl) of nickel and up to about 1 gpl cobalt. It would also be desirable to provide a fluid bed electrolyte cell for effecting separation of nickel and cobalt from fairly concentrated nickel solutions, for scavenging nickel and cobalt from ion exchange feed solutions, or even to remove impurities from nickel leach solutions, such as Cu, Cd, Zn, and the like.

OBJECTS OF THE INVENTION

It is an object of the invention to provide an improved fluid bed electrolysis system utilizing a cell containing a plurality of anode-cathode chambers.

Another object is to provide a fluid bed electrolysis cell having particular use in the extraction of metals from dilute solutions, particularly cells containing a plurality of anode-cathode chambers.

These and other objects will more clearly appear from the following disclosure and the accompanying drawing, wherein.

STATEMENT OF THE INVENTION

One embodiment of the invention is directed to the use of a fluid bed electrolysis cell in a fluid bed electrolysis system, the cell comprising an axially disposed anode surrounded by a cathode, which cathode in turn is surrounded by an anode, which anode in turn is surrounded by a cathode and so on, each of the anodes being separated from its adjacent cathode by a porous diaphragm, the anodes and cathodes being preferably concentrically disposed relative to each other.

Thus, stating it broadly, the invention is directed to a fluid bed electrolysis cell with multiple anode-cathode chambers. The cell comprises a first anode disposed axially in said electrolysis cell within an anode chamber surrounded by a first porous diaphragm, a first cathode surrounding the anode chamber, the first cathode being spaced such that an annular cathode chamber is provided adjacent and surrounding said anode chamber and adapted to support a fluidizable cathode bed of electrically conductive particulate material, and a second porous diaphragm spaced from and surrounding the first cathode, the second diaphragm defining an annular chamber surrounding the first cathode adapted to support a fluidizable cathode bed of electrically conductive particulate material. At least a second anode is provided surrounding the second diaphragm with a third porous diaphragm surrounding the second anode and at least a second cathode spaced from and surrounding the third diaphragm, the diaphragm and the at least second cathode defining a second cathode chamber adapted to support a fluidizable cathode bed of electrically conductive particulate material.

The cell is provided with means for continuously feeding into the annular cathode chambers and the anode chambers an electrolyte containing at least one electroplatable metal ion, the feed rate of the electrolyte being such as to maintain the bed of particulate material in the cathode chambers in an electrochemically active fluidized state, and cell exit means for the electrolyte including means for recirculating said electrolyte.

An advantage of the foregoing multiple anode-cathode cell is that copper can be quantitatively removed from very dilute solutions. Another advantage is that cobalt can be separated from nickel in the presence of high nickel concentrations over a wide range of electrolyte compositions.

Plating can be achieved in nickel laterite leach solutions, despite the unfavorable nickel to hydrogen ion concentration ratio. Moreover, impurities which generally appear in leach solutions, such as Cu, Cd and Zn, can be quantitatively removed at the fluidized cathode in the presence of over 60 gpl nickel.

Figure 1:
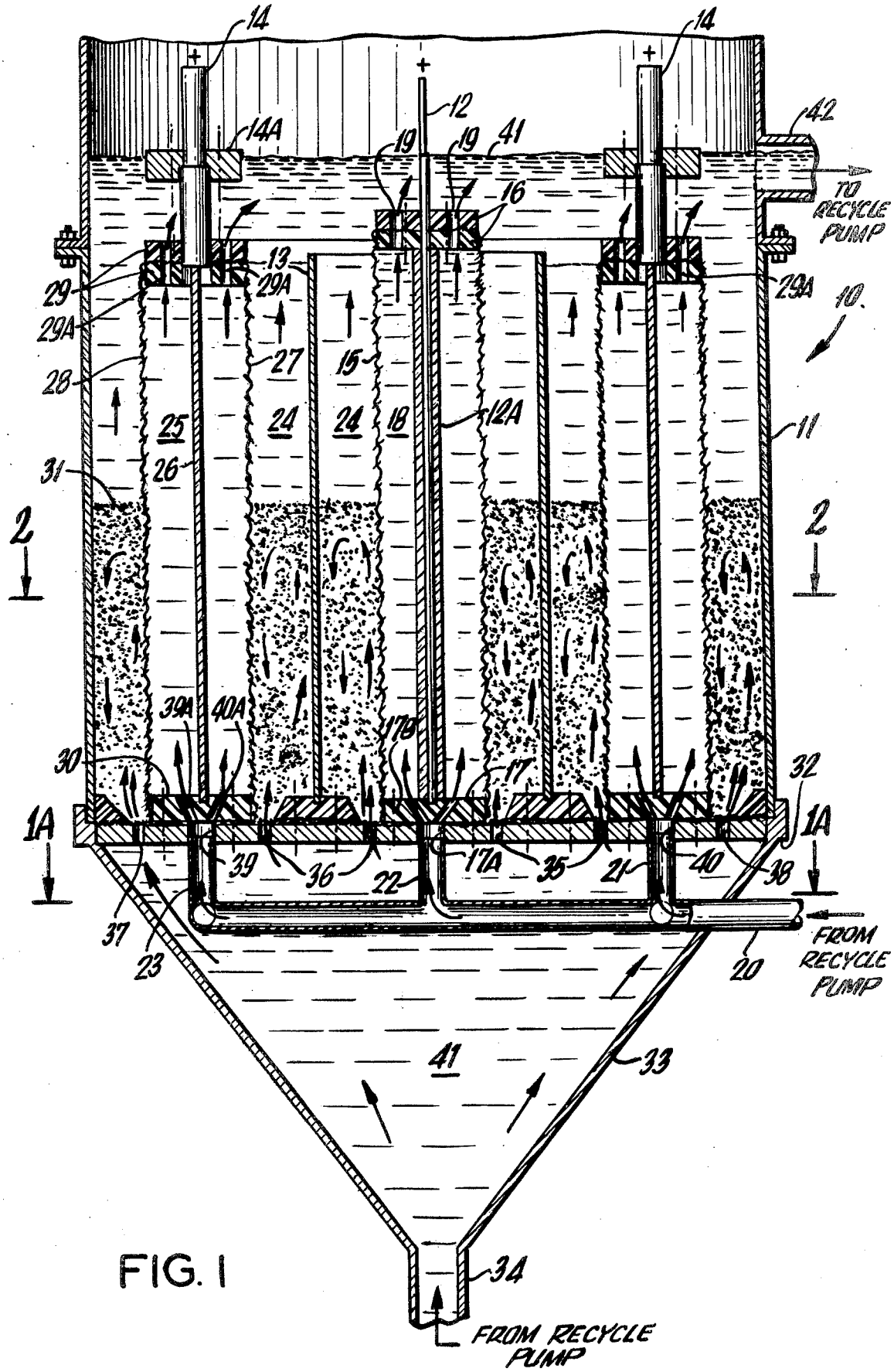
FIG. 1 shows schematically a cross-section in elevation of one embodiment of a fluid bed electrolysis cell provided by the invention.

One embodiment of a fluid bed electrolysis cell is illustrated in FIG. 1, the cell being designated generally by the numeral 10. The cell in this embodiment comprises a cylindrical vessel of stainless steel such that the outer wall 11 thereof is used as one of the cathodes. In this embodiment, the cell has a 12-inch diameter.

The cell is comprised of a center or first anode 12 surrounded concentrically by a first cathode 13, which in turn is surrounded by a second anode 26 (an annular anode), the wall 11 of the vessel being the second or last cathode. Of course, additional anodes and cathodes may be employed.

Figure 3:
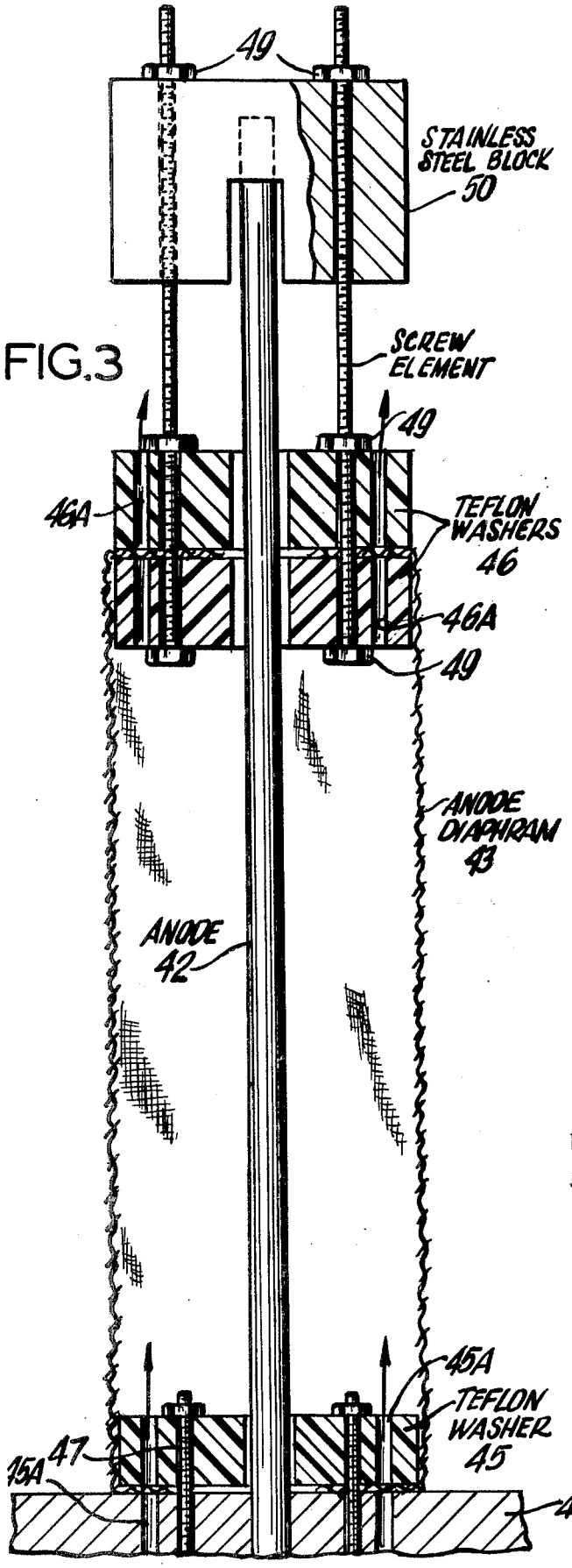
FIGS. 3 and 4 depict embodiments of a center anode in vertical cross-section surrounded by a porous diaphragm.
Figure 4:
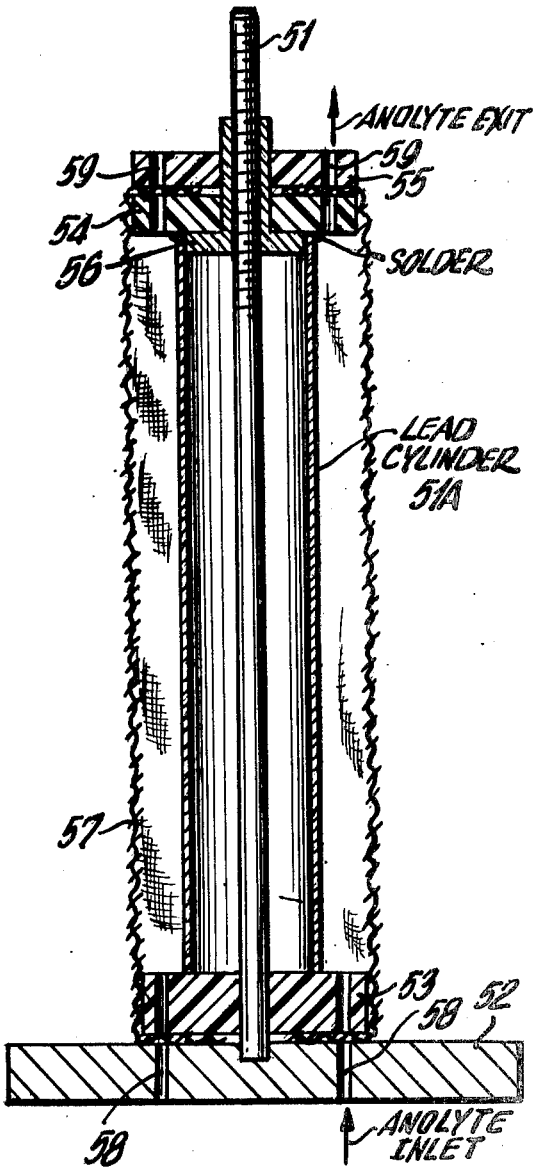

The center anode 12 may be made of substantially chemically inert electrically conductive material, such as titanium, and may comprise a titanium clad aluminum 12A surrounded by a sleeve of filter cloth 15 which is tension mounted between upper and lower washers 16 and 17, for example, of Teflon (registered trademark of polytetrafluoroethylene). A more detailed illustration of embodiments of this type of anode is shown in FIGS. 3 and 4.

Figure 1A:
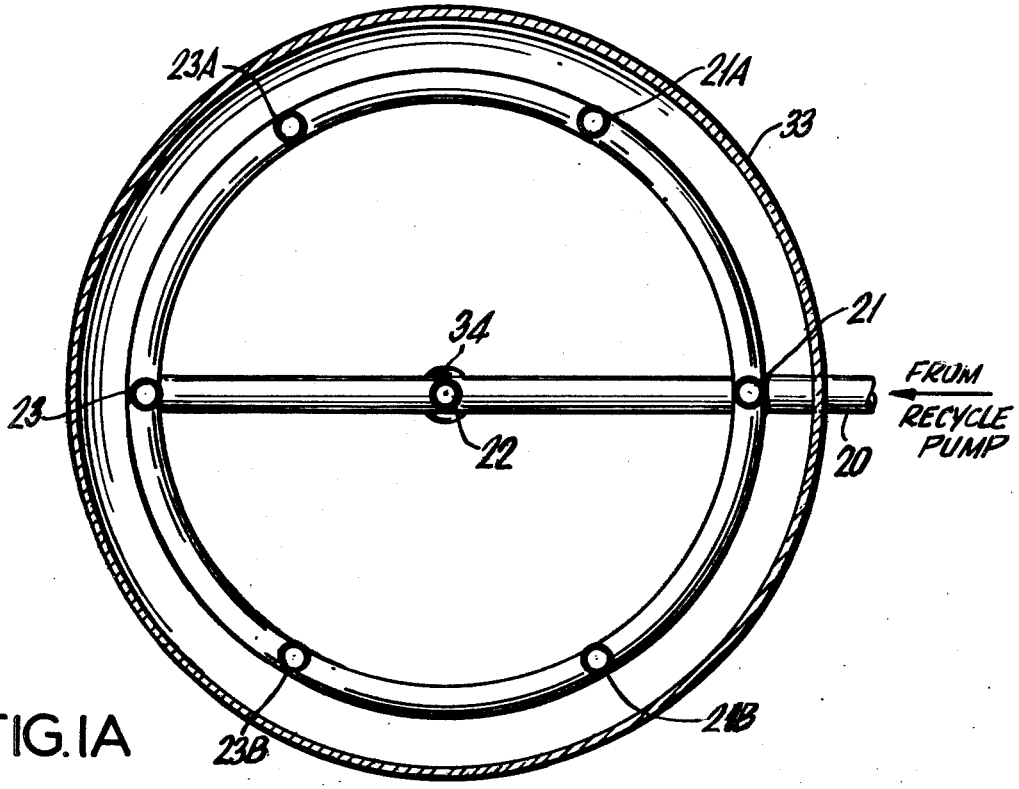
FIG. 1A is a cross-section of the bottom portion of the cell of FIG. 1 showing one technique of feeding electrolyte or anolyte into the anode chambers of the cell, particularly the annular anode chamber.

The bottom Teflon washers 17 have an axial opening through which the electrolyte is fed into anode chamber 18 and out through exit ports 19 in top washers 16, the electrolyte solution being fed by main conduit 20 via conduit branch 22; conduit branches 21, 21A, 21B, and 23, 23A, 23B being also provided for feeding the annular anode chamber of annular anode 26. (Note FIG. 1A which is a cross-section of FIG. 1 along line 1A—1A.)

The annular anode 26 has a plurality of electrical connectors 14 spaced along the periphery at the top thereof and extending axially upward for coupling to an electrical circuit, the connectors also including a stainless steel coupling block 14A for placing the porous diaphragm under tension to be described later.

Annular cathode 13 (e.g., copper) which is substantially concentrically located about the center anode chamber 18 defines an annular cathode chamber 24 relative to the center or first anode chamber 18 and the outer or second anode chamber 25.

Figure 5:
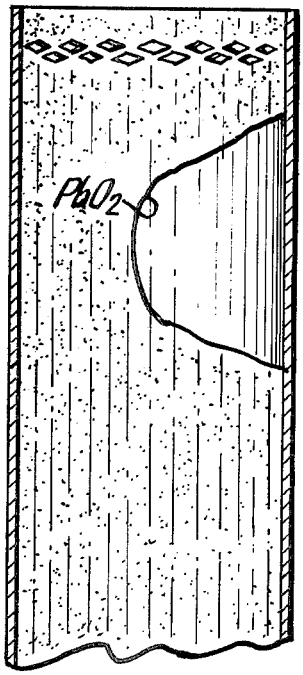
FIG. 5 is illustrative of one embodiment of an inert annular anode formed from expanded titanium sheet, the anode surface having an adherent coating of lead dioxide.

The second anode chamber 25 encompasses annular anode 26 which is preferably made of expanded titanium sheet (note also FIG. 5) having an adherent coating of lead dioxide thereon, although a cylindrically shaped lead anode can be employed having a layer of lead dioxide on its surface.

The annular anode chamber is formed by employing inner and outer annular surfaces 27, 28 of filter cloth which are gripped at the top via annular rings 29 of Teflon and the bottom similarly by annular rings 30, the filter cloth being gripped by the abutting faces of the superposed Teflon rings or other suitable ring material. The annularly arranged filter cloths 27, 28 are then placed under tension via threaded bolts coupled to stainless steel mounting blocks 14A. The tension connection is similar to that shown for the center anode depicted in the embodiments of FIGS. 3 and 4.

As stated earlier, the outer wall 11 of the cell which may be made of stainless steel serves as the outer cathode. Thus, a plurality of cathode chambers are provided isolated from the anode chambers and which contain a fluid bed 31 of electrically conductive particulate material, such as nickel, copper, or metal coated non-conductive particulate material. The fluid bed is retained in the cathode chambers to avoid shorting with the anode.

The base 32 of the cell also includes a downwardly extending conically shaped bottom or funnel 33 divided from the upper portion of said cell by base 32 which has duct openings therein selectively associated with the anode and cathode chambers through which the electrolyte is circulated.

The duct opening for the center anode is designated by the numeral 17A. The duct openings for the cathode chambers are designated by the numerals 35, 36, 37, and 38, while the duct openings for the annular anode chamber are designated by the numbers 39 and 40.

Electrolyte to the cathode chambers is fed through the funnel shaped bottom via opening 34, the electrolyte flowing into the cathode chambers as shown via duct openings 35 to 38. The electrolyte is fed to the anode chambers via conduit 20 through line branches 21, 21A, 21B, 22, 23, 23A, and 23B as shown in the electrolyte distributor means of FIG. 1A, the electrolyte entering the annular anode chamber via inlet ports 39A, 40A, and the center anode chamber via inlet ports 17B. Thus, the electrolyte 41 flows upwardly through the cell through each of the anode and cathode chambers to the top of the cell and out through exit port 42 to the recycle pump (note the flow sheet of FIG. 6), the electrolyte leaving the annular anode chamber via exit ports 29A, and the center anode chamber via exit ports 19. The cathode chambers and the anode chambers may each have their recycle pumps as shown in the fluid bed electrolysis cell system of FIG. 7.

Figure 2:
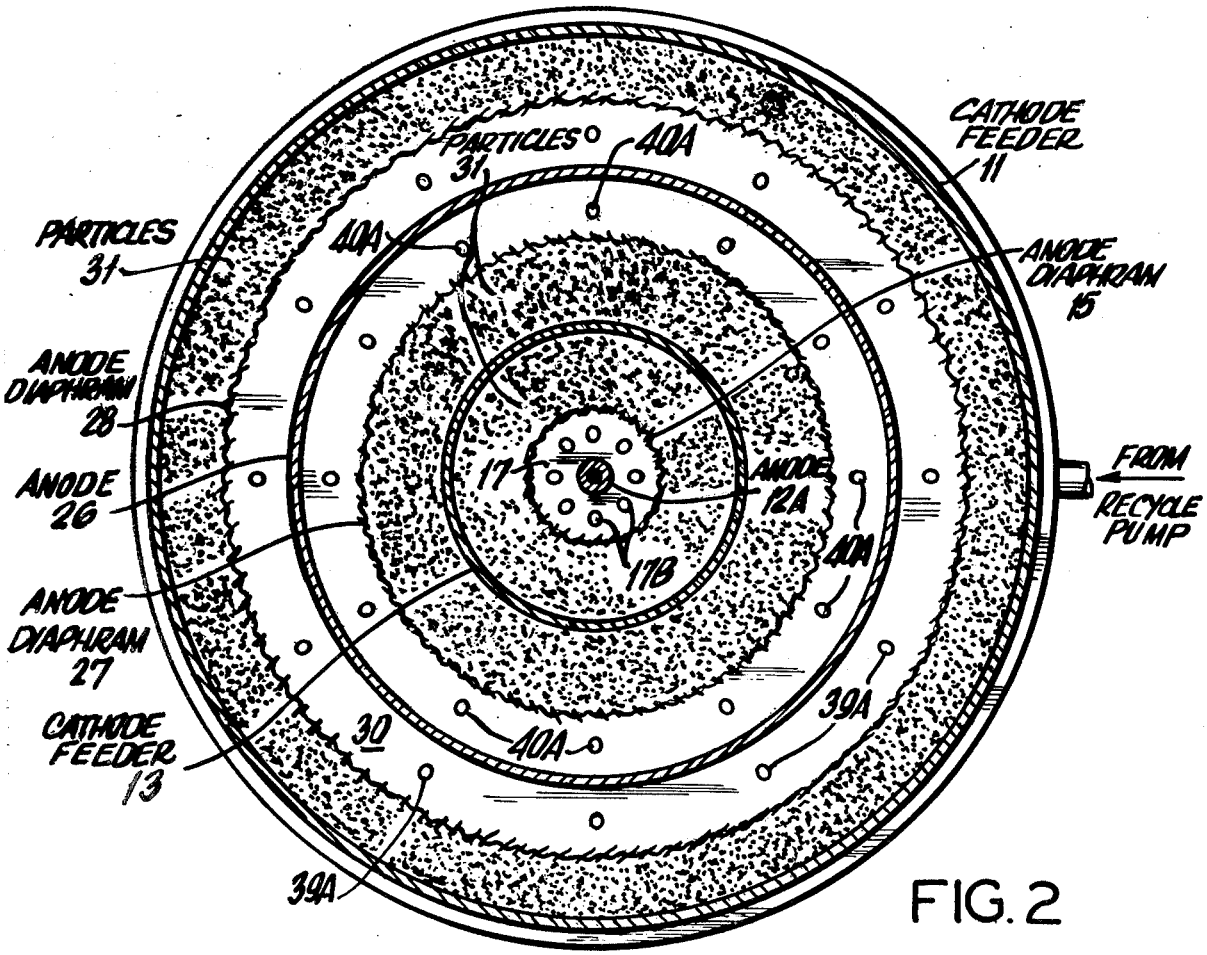
FIG. 2 is a sectional plan view of the cell as viewed along line 2—2 of FIG. 1.

The relationship in plan view between the anode and cathode chambers is depicted in FIG. 2.

The porous diaphragm surrounding the anodes may comprise perforated polyvinyl chloride (PVC) tubing with a filter cloth, e.g., of nylon, wrapped around the porous tube. It is preferred that a tension mounted porous diaphragm (filter cloth) be employed alone because of its flexibility.

One method of providing a tension mounted diaphragm is depicted in FIG. 3 which shows a center anode 42 surrounded by a tension mounted filter cloth diaphragm 43 of nylon. The anode is shown mounted to a base plate 44 and extending upwardly and passing through Teflon washers 45 and 46, washer 45 being mounted by screws 47 to base 44 with the annular sheath of diaphragm 43 tucked underneath the washer to provide a firm grip. Inlet ports 45A are provided at the bottom of the anode chamber and exit ports 46A at the top for the flow-through electrolyte.

The diaphragm material extends upward with the end thereof gripped between the abutting faces of washers 46 through which screw elements 48 pass, the screws having tightening nuts 49 for gripping the abutting washers tightly together. The end of anode 42 extends into stainless steel block 50, the screw elements passing through the blocks. Thus, by tightening nuts 49, the filter cloth diaphragm is put under tension as shown.

Another embodiment of an anode assembly is shown in FIG. 4 comprising an anode 51 in the form of a threaded titanium rod mounted to base plate 52. The titanium anode has electrically coupled to it anode cylinder 21A made of lead.

The anode 51 is provided with an axially mounted thick Teflon washer 53 fixed at its bottom end and two gripping Teflon washers 54, 55 at its top mounted on a threaded titanium nut or bushing 56, the bushing being threaded to the titanium and soldered to the lead portion of the anode. A sleeve of filter cloth 57 is tension mounted between the upper and lower Teflon washers as shown, washers 54, 55 gripping the end of the sleeve between them, the bottom end of the sleeve being fastened underneath Teflon washer 53. Tension is applied longitudinally of the sleeve by simply turning the titanium nut or bushing, causing it to move upward along the threaded anode. Flow-through ports 58 are provided at the bottom of the anode for passing anolyte therethrough from beneath base plate 52 and through Teflon washer 53. Similarly, flow-through ports 59 are provided at the top of the anode assembly passing through washers 54 and 55.

The technique for mounting the filter cloth diaphragm about the center anode also applies for mounting the inner and outer filter cloth sheaths about the annular anode illustrated in FIG. 1.

The advantage of using a woven fabric as a porous diaphragm is that it provides a substantially uniform porosity over the diaphragm surface. The exposed area may range from about 5% to 35% of the total surface area and generally from about 10% to 25% of the total area so long as the openings are less than the smallest particle size of the cathode particles.

The average particle size of the cathode particles should preferably be over about 100 mesh in size (Tyler Seive Size), for example, over about 150 microns. It is preferred that the average particle size be at least about 35 mesh in size (about 500 microns) and range up to about 10 mesh average size (about 2000 microns). The optimum size preferably varies inversely with the density of the cathode particles.

The volume of the cathode bed in the fluidized state (bed expansion) should be that volume which will assure electrochemical activity of the bed to pass current. For example, the volume of the fluidized bed should be at least about 5% greater than the volume of the bed at a state of rest (static volume) and range up to about 20% greater than the static volume, depending upon the average particle size of the electrically conductive particles. In addition to elemental powders, or alloy powders, the electrically conductive particles may comprise metal coated ceramic particles, or other metal coated non-conductive particles. The fluidized volume may preferably range from about 8% to 15% greater than the static bed volume.

The ability of ensuring uniform fluidization and of controlling bed expansion provides good current efficiency for reducing nickel concentration to low levels (e.g., to less than about 6 ppm). The same cell design can be used to reduce copper concentration to less than 1 ppm. Apparently, neither lower limit is attainable in conventional cells.

It is important in a fluid bed electrolysis system that the gases formed by electrolysis be disengaged from the solution during recycling of the solution through the cell. For one thing, it is important that oxygen be inhibited from building up in the anode chamber, otherwise the gas as it collects in the chamber will tend to push out the solution and cause a marked rise in the cell resistance. Thus, it is important that a uniform flow of the electrolyte be maintained through the anode and cathode chambers to sweep out the gases as they form and later disengage them from solution prior to solution recycle. One method is to provide an overflow dam as shown in FIG. 6.

Figure 6:
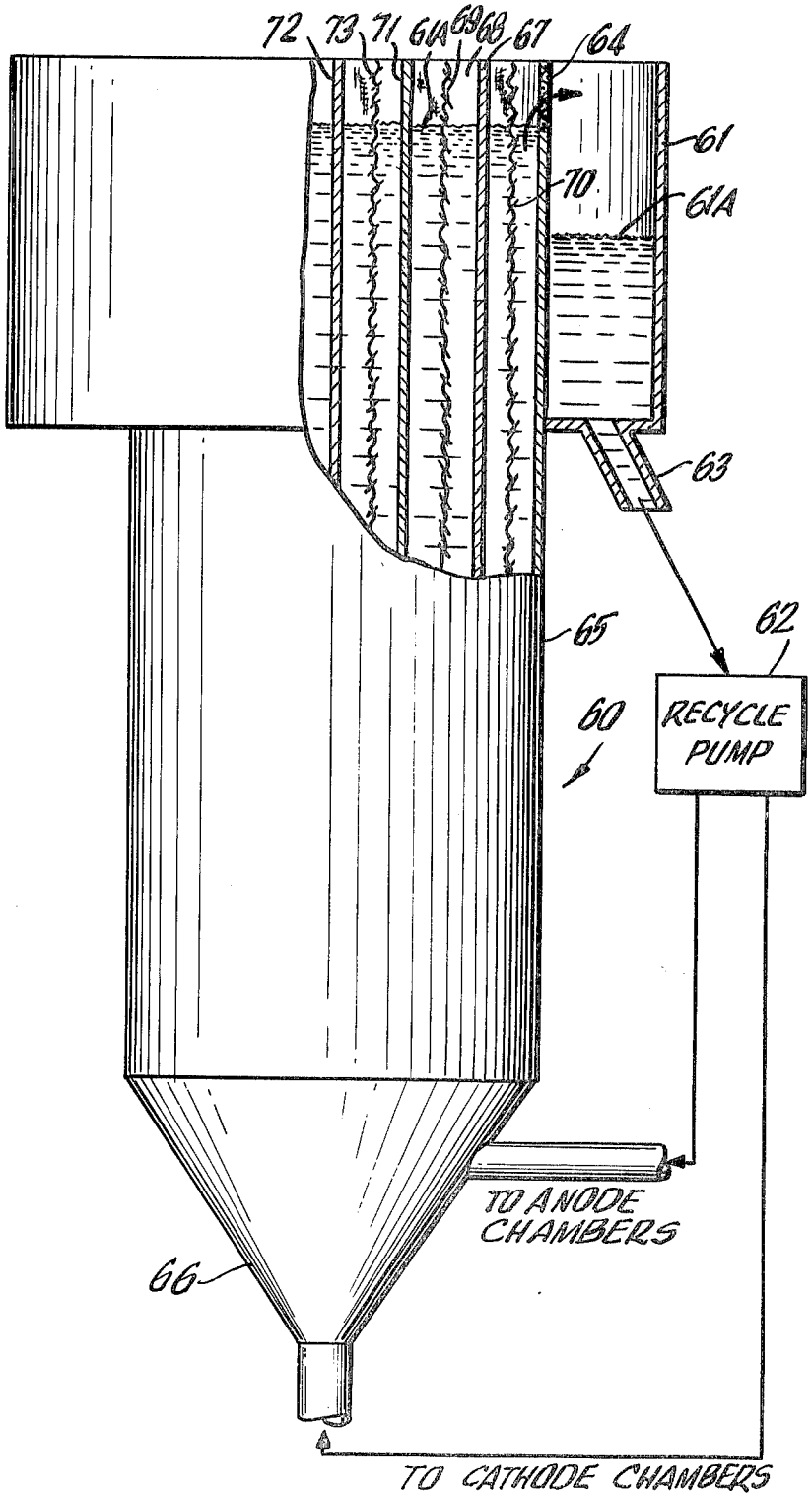
FIG. 6 is another embodiment of a fluid bed electrolysis cell in partial section showing the use of an overflow basin for the recirculating electrolyte.

The embodiment shown in FIG. 6 illustrates the concept of passing the electrolyte 61A directly through the anode chamber and through the annular cathode chamber. This is advantageous as it removes the oxygen which deposits at the anode from the cell during circulation of the electrolyte which overflows into a basin in which the gas can disengage itself from the solution before recycle.

Referring to FIG. 6, a cell 60 is shown with an overflow dam or basin 61 located at the top thereof into which circulating electrolyte flows for transfer to a recycle pump 62 via exit port 63. An overflow weir 64 in the form of a screen of inert material, e.g., polymeric fibers, such as nylon or polypropylene, is provided around at the top of the cell. The cell may be formed of a stainless steel column 65 having a conically shaped bottom or funnel 66 divided from the upper portion of the cell similarly as in FIG. 1. In place of the overflow dam, a solution reservoir may be employed series-connected to the electrolyte flow. Thus, the reservoir can serve as means for disengaging the gas from the solution before recycle.

In the partial cutaway at the top of the cell, outer annular anode 67 is shown disposed within annular anode chamber 68 defined by inner and outer porous diaphragms 69, 70, diaphragm 69 separating annular cathode 71 from the anode, the annular cathode in turn surrounding center anode 72 which in turn is surrounded by porous diaphragm 73.

While the recycle pump shown circulates the electrolyte through the anode and cathode chambers, it will be appreciated that two pumps may be employed, one for the anolyte and the other for the catholyte, each of the pumps receiving the electrolyte from reservoir or dam 61. (Note the flow sheet of FIG. 7.)

Figure 7:
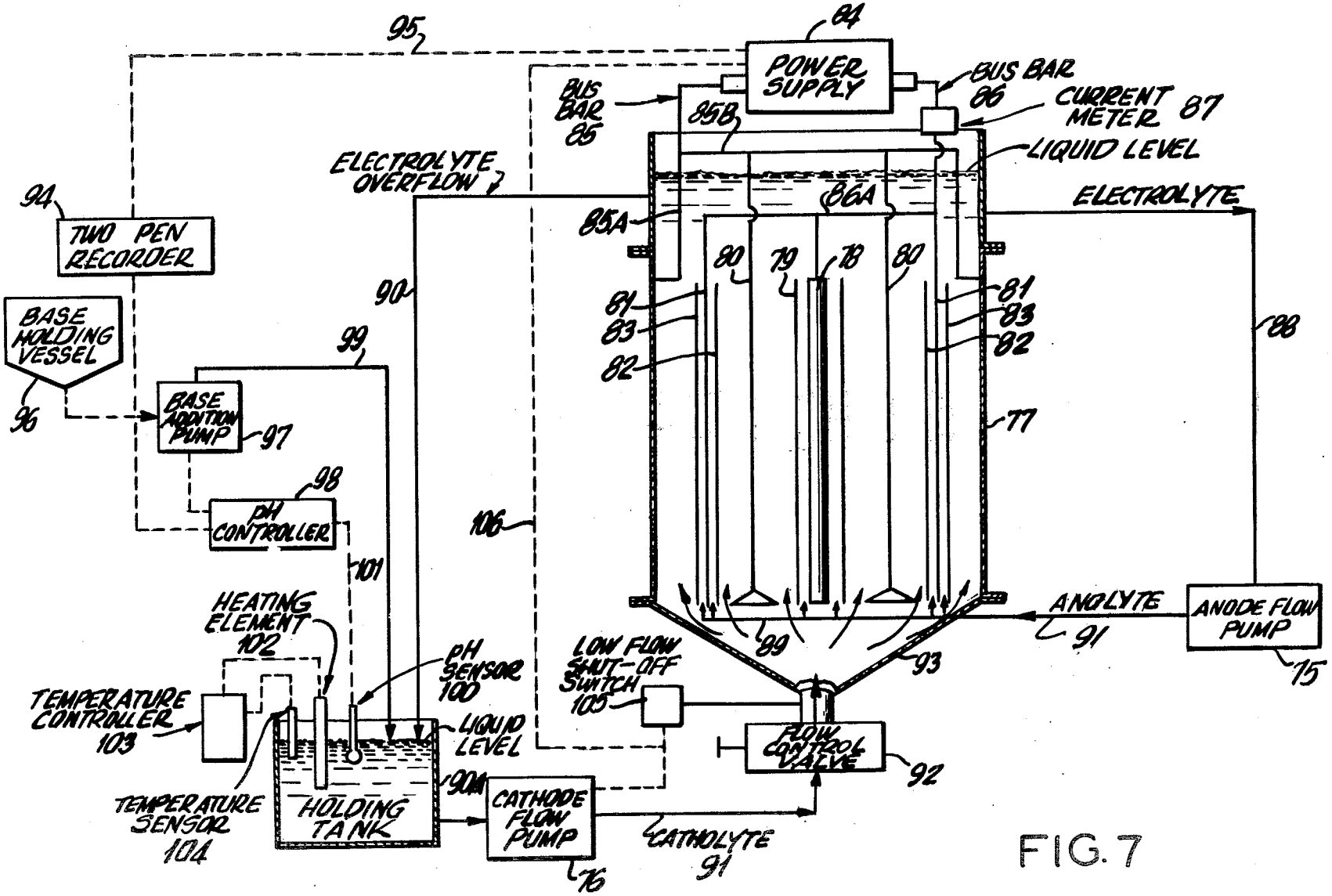
FIG. 7 depicts one embodiment of a fluid bed electrolysis system utilizing the cell provided by the invention.

A schematic representation of a fluid bed electrolysis system provided by the invention is shown in FIG. 7. As will be noted, anode flow pump 75 is employed to feed anolyte to the anode chambers and cathode flow pump 76 used to feed catholyte to the cathode chambers, both pumps receiving the electrolyte from the cell.

The cell 77 (12 inches in diameter) is shown schematically and has disposed within it as in FIG. 1 a center anode 78 surrounded by a diaphragm 79, the anode-diaphragm 78, 79 being in turn surrounded by annular cathode 80, the annular cathode 80 in turn being surrounded by annular anode 81 disposed within an annular anode chamber defined by inner and outer porous diaphragm 82, 83. The vessel 77 in turn surrounds the annular anode chamber, and being made of electrically conductive material, e.g., such relatively inert material as stainless steel, titanium, etc., functions as the outside or last cathode.

A power supply 84 is provided from which the requisite power is derived for each part of the system. Bus bars 85, 86 are shown, bus bar 85 being connected to the cathode part of the circuit through branch lines 85A and 85B, branch line 85A being coupled to the cathode wall of the container and branch line 85B being coupled to annular cathode 80.

Similarly, bus bar 86 is coupled through current meter 87 to branch line 86A which in turn is coupled to center anode 78 and annular anode 81.

The fluid bed particles have been omitted from the schematic drawing for purposes of clarity, reference being made to FIG. 1 as to the disposition of the fluid bed.

Electrolyte is drawn from the top of the cell via line 88 by anode pump 75 which then recycles the electrolyte via line 89 into each of the anode chambers as shown by the flow arrows.

Likewise, cathode flow pump 76 receives electrolyte overflow via line 90 by way of holding tank 90A, the electrolyte being recirculated as catholyte via line 91 through flow control valve 92 into conical bottom 93 of the vessel and through the cathode chambers as shown by the arrows.

The holding tank may serve as a reservoir for the electrolyte during which electrolytically formed gases can disengage from the solution prior to recirculation.

Controls are provided to insure efficient running of the system. Thus, a two pen recorder 94 is provided electrically coupled to the power supply via line 95. The pH value is recorded using one channel of the double pen recorder. The second channel records the cell voltage measured across power supply 84.

The pH control of the solution is important, and this is achieved by providing for a base holding vessel 96 (e.g., a solution of sodium hydroxide or other base) for feeding to base addition pump 97 which is coupled to pH controller 98, the pump 97 feeding base to the holding tank 90A via line 99 when called for.

In addition, the pH controller is coupled to pH sensor 100 via line 101 which sensor is in contact with the electrolyte in the holding tank. The holding tank is provided with a heating element 102 which is coupled to a temperature controller 103 which operates through a temperature sensor 104 in the holding tank. Heating the solution is important to obtain optimum plating efficiency.

The cathode flow pump is controlled via a low flow shut-off switch 105, the switch being coupled to the power supply 84 via line 106. When the flow falls below a predetermined value, the switch automatically shuts off the pump.

As stated hereinbefore, the anode material may comprise any electrically conductive inert material. The anode may be made of a lead-silver alloy, or lead-calcium alloy, or titanium with preferably an adherent lead dioxide coating or layer, and the like.

The test results obtained in fluid bed electrolysis cells of the copending applications (U.S. Ser. No. 012,177 and No. 012,778) are applicable to the multiple anode-cathode cell of the invention, except that the present cell of the invention has a higher capacity in terms of the amount of fluid bed that can be used and the amount of current that can be employed. The following example is illustrative of the results which can be obtained using a two-electrode 5-inch cell containing 25 pounds of a fluid bed charge of reduced nickel oxide.

EXAMPLE

Tests were conducted in the aforementioned 5-inch diameter cell; the fluid bed comprising reduced nickel oxide was 12 inches high, the solution containing 4 gpl $Ni^{+2}$, 60 gpl $Na_2SO_4$ and having a pH of 3.0. The reduced nickel oxide ranged in size from about 600 to 1400 microns, the weight being about 25 lbs. (about 11,300 grams). The volume of the solution was 22 liters and the amount of current 125 amps. The particles provided a current density of approximately 7.35 amps/$M^2$. The results obtained are given in Table 1 as follows:

TABLE 1

| Time (min.) | $Ni^{+2}$ (gpl) | Cell Voltage |
|---|---|---|
| 0 | 4 | 9.1 |
| 20 | 3.2 | 9.2 |
| 31 | 2.4 | 9.2 |
| 40 | 1.72 | 9.1 |
| 60 | 0.88 | 9.1 |
| 80 | 0.30 | 9.4 |
| 100 | 0.062 | 9.4 |

The current efficiency at 0.062 gpl Ni was 38%. The power consumption was 10.2 KWH/lb. of plated metal.

Another test was conducted using a current flow of 250 amps, a fluid bed height of reduced nickel oxide of 24 inches, and 24 liters of solution containing 13.4 gpl $Ni^{+2}$ and 60 gpl $Na_2SO_4$. The size range of the nickel particles was about the same.

The results obtained are as follows:

TABLE 2

| Time (min.) | $Ni^{+2}$ (gpl) | Cell Voltage |
|---|---|---|
| 0 | 13.4 | 7.9 |
| 27 | 10.4 | 7.9 |
| 45 | 8.8 | 7.8 |
| 60 | 6.8 | 7.8 |
| 75 | 5.0 | 7.9 |
| 90 | 1.76 | 7.95 |
| 108 | 0.82 | 7.8 |

The current efficiency at 0.82 gpl $Ni^{+2}$ was 61% (5.24 KWH/lb. metal plated) and at 1.76 gpl $Ni^{+2}$ about 71% (4.35 KWH/lb. metal plated). The electrolysis was stopped before removing substantially all of the nickel.

As stated earlier, the foregoing results are applicable to the multiple anode-cathode cell of the invention. In a 12-inch diameter cell of the type shown in FIG. 1 and shown schematically in FIG. 7, a loading of particulate nickel (about 500 to 800$\mu$) would be about 350 pounds. Based on the foregoing example, the total current would be approximately 1750 amps or higher at about 8 volts.

The cell has a wide diversity of uses in the treatment of various kinds of electrolytes. For example, the multiple anode-cathode cell may be employed to separate cobalt from nickel in a solution containing say 54 grams per liter (gpl) of nickel and 1.2 gpl cobalt. This can be important in the electrolytic treatment of pregnant leach liquors obtained in the leaching of nickel laterites. For example, a leach liquor containing 54 gpl Ni and 1.2 gpl Co and having a Ni/Co ratio of about 46.8 can be treated in accordance with the cell of the invention to remove cobalt selectively and provide an end solution with a Ni/Co ratio of over 1000:1.

Nickel leach solutions containing copper, cadmium and zinc as impurities can be treated electrolytically to remove selectively the impurities while leaving behind substantially all of the nickel.

In summary, the cell and system of the invention enable the carrying out of a process for extracting metal ions from electrolytes by fluid bed electrolysis. The process resides in establishing an electrolyte bath containing at least one metal value in the fluid bed electrolysis cell, the cell comprising a first anode disposed axially in the cell within an anode chamber surrounded by a porous diaphragm, and a first cathode surrounding the anode chamber, the cathode in turn being surrounded by an annular anode disposed within an annular anode chamber defined by a pair of concentrically spaced porous diaphragms, the annular anode with its annular chamber being in turn surrounded by a second or last cathode. A flow of electrolyte is maintained through the cell by passing the electrolyte axially through the cell starting beneath the fluidizable bed at a rate sufficient to maintain the bed in a fluidized electro-chemically active cathodic state at an expanded volume ranging up to about 20% greater than the static bed volume. The cell is electrolytically activated to effect deposition of at least one metal value on the particulate material of the fluidized bed, the electrolysis being continued for a time sufficient to effect the desired amount of metal deposition from the electrolyte.

As will be appreciated, a group of series-connected cells may be employed in which the electrolyte is passed from one cell to another to achieve the same effect as recirculating the electrolyte within the same cell.

The invention also provides a system in combination with the aforementioned fluid bed electrolysis cell, the system comprising means for determining the change in pH of the electrolyte in said cell, including means for controlling the pH. The system also has means for recording the pH and for recording the cell voltage, including power means for electro-chemically activating the fluid bed electrolysis cell and the recording means.

In operating the fluid bed cell, the amount of particulate material employed should be such as to provide an expanded fluid bed uniformly disposed about the anode chamber and a surface area calculated to provide the desired cathode current density falling within the range of about 0.5 to 25 amps per square meter, e.g., 1 to 15 amps per square meter of bed surface.

The characteristics of each electrolyte can be easily determined as to pH requirements, current density, cell voltage, and the like.

While the fluid bed cells are illustrated herein as being cylindrical, it will be appreciated that rectangular cells are also included within the purview of the invention so long as they contain anode compartments and annular cathode compartments (annular rectangular compartments) that function in the same way as those described herein.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A fluid bed electrolysis cell with multiple anode-cathode chambers which comprises, a first anode disposed axially in said electrolysis cell within an anode chamber surrounded by a first porous diaphragm, a first cathode surrounding said anode chamber, said cathode being spaced such that an annular cathode chamber is provided adjacent and surrounding said anode chamber and adapted to support a fluidizable cathode bed of electrically conductive particulate material, a second porous diaphragm spaced from and surrounding said first cathode, said second diaphragm defining an annular chamber surrounding said first cathode adapted to support a fluidizable cathode bed of electrically conductive particulate material, at least a second anode surrounding said second diaphragm, a third porous diaphragm surrounding said second anode and at least a second cathode spaced from and surrounding said third diaphragm, said third diaphragm and said at least second cathode defining a second cathode chamber adapted to support a fluidizable cathode bed of electrically conductive particulate material, means for continuously feeding into said annular cathode chambers and said anode chambers an electrolyte containing at least one electroplatable metal ion, the feed rate of said electrolyte being such as to maintain said bed of particulate material in said cathode chambers in an electro-chemically active fluidized state, and cell exit means for said electrolyte.

2. The fluid bed electrolysis cell of claim 1, wherein the porous diaphragm is formed of a tubular sheath of woven filter cloth.

3. The fluid bed electrolysis cell of claim 2, wherein said tubular sheath of filter cloth is held under longitudinal tension.

4. The fluid bed electrolysis cell of claim 2, wherein said porous diaphragm has an exposed area ranging from about 5 to 35% of the total diaphragm area.

5. The fluid bed electrolysis cell of claim 4, wherein the exposed area of the diaphragm ranges from about 10% to 25%.

6. The fluid bed electrolysis cell of claim 1, including means for recirculating electrolyte through said cell.

7. The fluid bed electrolysis cell of claim 6, including electrolyte reservoir means through which the electrolyte is circulated to promote disengagement of electrolytically formed gases from said electrolyte prior to recycle.

8. A fluid bed electrolysis system including a cell with multiple anode-cathode chambers which comprises, a first anode disposed axially in said electrolysis cell within an anode chamber surrounded by a first porous diaphragm, a first cathode surrounding said anode chamber, said cathode being spaced such that an annular cathode chamber is provided adjacent and surrounding said anode chamber and adapted to support a fluidizable cathode bed of electrically conductive particulate material, a second porous diaphragm spaced from and surrounding said first cathode, said second diaphragm defining an annular chamber surrounding said first cathode adapted to support a fluidizable cathode bed of electrically conductive particulate material, at least a second anode surrounding said second diaphragm, a third porous diaphragm surrounding said second anode and at least a second cathode spaced from and surrounding said third diaphragm, said third diaphragm and said at least second cathode defining a second cathode chamber adapted to support a fluidizable cathode bed of electrically conductive particulate material, means for continuously feeding into said annular cathode chambers and said anode chambers an electrolyte containing at least one electroplatable metal ion, the feed rate of said electrolyte being such as to maintain said bed of particulate material in said cathode chambers in an electro-chemically active fluidized state, cell exit means for said electrolyte including means for recirculating said electrolyte, means for determining the change in pH of said electrolyte including means for controlling the pH of said electrolyte, means for recording the pH of said electrolyte, means for recording the cell voltage of said system, and power means for electro-chemically activating said cell and for operating said recording means.

9. The fluid bed electrolysis system of claim 8, wherein the porous diaphragm is formed of a tubular sheath of woven filter cloth.

10. The fluid bed electrolysis system of claim 9, wherein said tubular sheath of filter cloth is held under longitudinal tension.

11. The fluid bed electrolysis system of claim 9, wherein said porous diaphragm has an exposed area ranging from about 5% to 35% of the total diaphragm area.

12. The fluid bed electrolysis system of claim 9, wherein the exposed area of the diaphragm ranges from about 10% to 25%.

13. The fluid bed electrolysis system of claim 8, including means for recirculating electrolyte through said cell.

14. The fluid bed electrolysis system of claim 13, including electrolyte reservoir means through which the electrolyte is circulated to promote disengagement of electrolytically formed gases from said electrolyte.

* * * * *